US010900315B2

(12) United States Patent
Xiao

(10) Patent No.: US 10,900,315 B2
(45) Date of Patent: Jan. 26, 2021

(54) TUBING HANGER SYSTEM

(71) Applicant: Saudi Arabian Oil Company, Dhahran (SA)

(72) Inventor: Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 116 days.

(21) Appl. No.: 16/291,934

(22) Filed: Mar. 4, 2019

(65) Prior Publication Data

US 2020/0284118 A1 Sep. 10, 2020

(51) Int. Cl.

| | |
|---|---|
| ***E21B 33/04*** | (2006.01) |
| ***E21B 33/047*** | (2006.01) |
| ***F16L 11/22*** | (2006.01) |
| *E21B 43/12* | (2006.01) |

(52) U.S. Cl.

CPC ..... *E21B 33/0407* (2013.01); *E21B 43/128* (2013.01)

(58) Field of Classification Search

CPC ..... E21B 33/03; E21B 33/0407; E21B 33/04; E21B 33/047; F16L 11/22

See application file for complete search history.

(56) References Cited

U.S. PATENT DOCUMENTS 3,638,732 A * 2/1972 Huntsinger ..... E21B 17/023 166/379
4,154,302 A 5/1979 Cugini
4,181,175 A 1/1980 McGee et al.
4,289,199 A 9/1981 McGee
4,491,176 A 1/1985 Reed
4,627,489 A 12/1986 Reed
5,848,642 A * 12/1998 Sola ..... E21B 17/203 166/77.2

(Continued)

FOREIGN PATENT DOCUMENTS

| | | |
|---|---|---|
| EP | 0637675 | 2/1995 |
| GB | 2504104 | 1/2014 |
| WO | WO 2016012245 | 1/2016 |

OTHER PUBLICATIONS

International Search Report and Written Opinion issued in International Application No. PCT/US2020/020770 dated May 18, 2020, 14 pages.

*Primary Examiner* — Kenneth L Thompson
(74) *Attorney, Agent, or Firm* — Fish & Richardson P.C.

(57) ABSTRACT

A hanger system for a well includes a pipe spool and a tubing hanger removably coupled to the pipe spool. The pipe spool includes a spool housing defining a cylindrical spool bore extending longitudinally through the spool housing, an electrical port in the spool housing with an electrical port opening in an inner surface of the spool housing, a communication port in the spool housing with a communication port opening in the inner surface of the spool housing, and a control port in the spool housing having a control port opening in the inner surface of the spool housing. The communication port connects to a communication module, the control port connects to a control fluid supply, and the electrical port connects to a power supply. The tubing hanger includes a hanger housing, and an electrical conduit, communication conduit, and control conduit extending through the hanger housing.

20 Claims, 4 Drawing Sheets

(56) References Cited

U.S. PATENT DOCUMENTS

| | | | | |
|---|---|---|---|---|
| 7,699,099 | B2 * | 4/2010 | Bolding | E21B 33/03 166/89.1 |
| 7,770,650 | B2 | 8/2010 | Young et al. | |
| 9,593,561 | B2 | 3/2017 | Xiao et al. | |
| 2003/0141071 | A1 | 7/2003 | Hosie | |
| 2010/0206577 | A1 | 8/2010 | Martinez | |
| 2011/0300008 | A1 | 12/2011 | Fielder et al. | |
| 2015/0068769 | A1 | 3/2015 | Xiao et al. | |
| 2015/0330194 | A1 * | 11/2015 | June | E21B 33/043 166/351 |
| 2015/0354308 | A1 * | 12/2015 | June | E21B 43/128 166/65.1 |
| 2018/0058157 | A1 | 3/2018 | Melo et al. | |

* cited by examiner

TUBING HANGER SYSTEM

TECHNICAL FIELD

This disclosure relates to hydrocarbon well operations.

BACKGROUND

Production operations of a hydrocarbon well sometimes includes deployment of downhole production equipment, such as electric submersible pumps, on a coil tubing to promote flow of production fluids uphole in a wellbore. When production equipment needs to be removed from the wellbore, a workover rig is required to pull the tubing and the production equipment out of the well. Workover rigs are costly, and can delay production operations at the well.

SUMMARY

This disclosure describes hanger systems for a well, for example, tubing hangers for supporting and connecting well tubing.

Some aspects of the disclosure encompass a hanger system for a well, the hanger system including a pipe spool configured to be disposed at a wellhead of a well, and a tubing hanger configured to removably couple to the pipe spool. The pipe spool includes a spool housing defining a cylindrical spool bore extending longitudinally through the spool housing, an electrical port in the spool housing having an electrical port opening in an inner surface of the spool housing, the electrical port configured to connect to a power supply, a communication port in the spool housing having a communication port opening in the inner surface of the spool housing, the communication port configured to connect to a communication module, and a control port in the spool housing having a control port opening in the inner surface of the spool housing, the control port configured to connect to a control fluid supply. The tubing hanger is configured to be disposed in the cylindrical spool bore, and includes a hanger housing defining a hanger bore extending from a first longitudinal end of the hanger housing to a second longitudinal end of the hanger housing opposite the first longitudinal end. The tubing hanger includes an electrical conduit extending through the hanger housing, a first end of the electric conduit configured to align with the electrical port opening of the pipe spool, and a second end of the electrical conduit opposite the first end configured to connect to a first channel of a coil tubing, a communication conduit extending through the hanger housing, a first end of the communication conduit configured to align with the communication port opening of the pipe spool, and a second end of the communication conduit opposite the first end configured to connect to a second channel of the coil tubing, and a control conduit extending through the hanger housing, a first end of the control conduit configured to align with the control port opening of the pipe spool, and a second end of the control conduit opposite the first end configured to connect to a third channel of the coil tubing.

This, and other aspects, can include one or more of the following features. The hanger housing can include a shoulder to land on and engage a corresponding shoulder profile of the spool housing. The tubing hanger can include an orientation element, and the pipe spool can include an orientation profile, the orientation element to engage with the orientation profile to rotationally index the tubing hanger to the pipe spool. The orientation element of the tubing hanger can include an orientation shoe, and the orientation profile of the pipe spool can include an orientation pin extending radially into the spool bore. The hanger system can further include a locking mechanism to detachably couple the tubing hanger to the pipe spool. The locking mechanism can include a lock pin of the pipe spool, the lock pin to engage with a locking profile of the tubing hanger. The tubing hanger can include a latching profile in the hanger housing at the first longitudinal end of the hanger housing, the latching profile to engage a latching mechanism. The latching profile can include a fishing neck or threading. The tubing hanger can include a sealing element to sealingly engage with the pipe spool. The tubing hanger can include a connector portion at the second longitudinal end of the hanger housing, where the electrical conduit, the communication conduit, and the control conduit extend to the connector portion, the connector portion to connect to and support the coil tubing. The pipe spool can include a bypass flow channel fluidly connecting a first portion of spool bore downhole of the tubing hanger to a second portion of the spool bore uphole of the tubing hanger.

Certain aspects of the disclosure encompass a method for connecting a hanger system in a well. The method includes positioning a tubing hanger in a cylindrical spool bore of a pipe spool of a wellhead, and aligning, with an orientation element of the tubing hanger, the tubing hanger with the pipe spool. Aligning the tubing hanger with the pipe spool includes aligning an electrical conduit of the tubing hanger with an electrical port of the pipe spool, the electrical port configured to connect to a power supply, and the electrical conduit configured to connect to a first channel of a coil tubing, aligning a communication conduit of the tubing hanger with a communication port of the pipe spool, the communication port configured to connect to a communication module, and the communication conduit configured to connect to a second channel of a coil tubing, and aligning a control conduit of the tubing hanger with a control port of the pipe spool, the control port configured to connect to a control fluid supply, and the control conduit configured to connect to a third channel of a coil tubing. The method further includes directing, with axial bore in the tubing hanger, fluid flow from the coil tubing through the tubing hanger.

This, and other aspects, can include one or more of the following features. Positioning the tubing hanger in the spool bore of the pipe spool can include landing on and engaging, with a shoulder of the tubing hanger, a shoulder profile of the pipe spool. The orientation element of the tubing hanger can include an orientation shoe, and aligning the tubing hanger with the pipe spool can include engaging, with the orientation shoe, an orientation pin of the pipe spool extending radially into the spool bore. The orientation element of the tubing hanger can include an orientation pin, and aligning the tubing hanger with the pipe spool can include engaging, with the orientation pin, an orientation slot of the pipe spool. The method can further include sealing the tubing hanger to the pipe spool with a sealing element of the tubing hanger. The method can further include locking the tubing hanger to the pipe spool with a locking mechanism of the pipe spool, the locking mechanism comprising a lock pin. The method can further include engaging, with a latching profile of the tubing hanger, a retrieval tool. The method can further include guiding, with the electrical conduit, an electrical connection from the power supply to the first channel of the coil tubing, guiding, with the communication conduit, a communication line from the communication module to the second channel of the coil tubing, and guiding, with the control conduit, a control fluid from the control fluid supply to the third channel of the coil tubing.

Certain aspects of the disclosure describe a well hanger for a well. The well hanger includes a tubing hanger coupled to and supporting a coil tubing, the tubing hanger configured to be removably coupled to a pipe spool. The tubing hanger includes a hanger housing defining a hanger bore extending from a first longitudinal end of the hanger housing to a second longitudinal end of the hanger housing opposite the first longitudinal end. The tubing hanger includes an electrical conduit extending through the hanger housing, a first end of the electric conduit configured to align with an electrical port opening of the pipe spool, and a second end of the electrical conduit being connected to a first channel of a coil tubing, a communication conduit extending through the hanger housing, a first end of the communication conduit configured to align with a communication port opening of the pipe spool, and a second end of the communication conduit being connected to a second channel of the coil tubing, and a control conduit extending through the hanger housing, a first end of the control conduit configured to align with a control port opening of the pipe spool, and a second end of the control conduit being connected to a third channel of the coil tubing.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
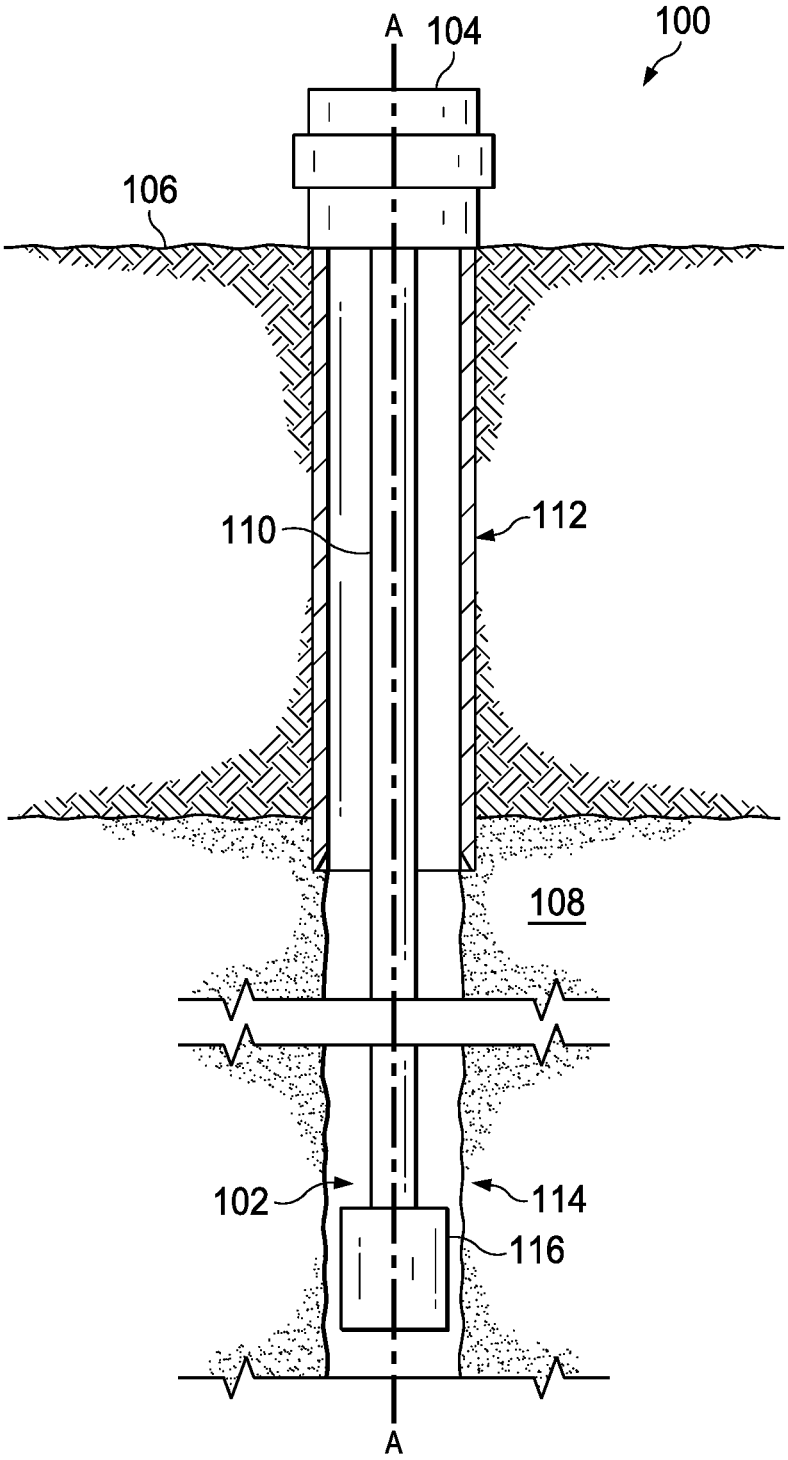
FIG. 1 is a schematic, partial cross-sectional side view of an example well system.

This disclosure describes tubing hanger systems used in wellheads of well systems, where the tubing hanger systems support tubing, such as coil tubing. The tubing can connect to and support a downhole well tool. In some instances, a tubing hanger system of a wellhead connects to and supports a coil tubing and an electric submersible pump (ESP) in a wellbore. The tubing hanger system includes a pipe spool formed in or otherwise coupled to the wellhead, and a tubing hanger connected to and supported by the pipe spool, where the tubing hanger couples to the coil tubing. The pipe spool and tubing hanger include corresponding axial support features and axial indexing features that mount the tubing hanger on the pipe spool at a desired axial position and rotational orientation, for example, to align port openings of the pipe spool with conduit openings of the tubing hanger. The tubing hanger includes one or more conduits through a housing of the tubing hanger that connect the ports of the pipe spool with corresponding channels in the coil tubing. The conduits can include an electrical conduit for connection of power between the wellhead and the coil tubing, a communication conduit for connection of signal and data between the wellhead and the coil tubing, a control conduit for connection of control fluid between the wellhead and the coil tubing, a combination of these conduits, or other conduits. In some instances, the coil tubing includes an electrical channel, communication channel, control channel, or a combination of these channels integral with a wall of the coil tubing (for example, between a radially inner wall and a radially outer wall of the coil tubing), which connect to the ESP to provide power, control (for example, hydraulic fluid, chemical fluid, or other control fluid), communication (for example, fiber optic or other communication type), or a combination of these to the ESP.

In some coil tubing and ESP operations, power, communication, or control is provided to a downhole well tool via dedicated lines alongside the coil tubing, separate from the coil tubing, or are simply not communicated from the surface to the downhole well tool. In the present disclosure, the orientation of the pipe spool, tubing hanger, and coil tubing, and their respective ports, conduits, and channels, allows a more secure communication of power, fluid, data, or other kinds of communication between surface sources (such as a power source, communication module, control fluid supply, or others) and a downhole well tool connected to and supported by the coil tubing. For example, providing power, communication, and control conduits integrally formed in the tubing hanger and the coil tubing, instead of separately provided on one or more dedicated conduits separate from the tubing hanger or coil tubing, provides a more reliable connection between the source and the downhole well tool. The tubing hanger mounts at the wellhead (for example, on the pipe spool) and supports the coil tubing such that connections for power, communication, or control can be made easily at the wellhead (for example, at the surface of the well) and are directly connected to the downhole well tool via the aligned series of ports and conduit, while also allowing for deployment and retrieval of the tubing hanger and coil tubing without requiring a workover rig or nippling operation of the wellhead. Rigless operation can be impossible or too complicated if power, communication, and control lines or conduits are to be strapped or clamped outside of the coil tubing.

FIG. 1 is a schematic partial cross-sectional side view of an example well system 100 that includes a substantially cylindrical wellbore 102 extending from a wellhead 104 at a surface 106 downward into the Earth into one or more subterranean zones of interest 108 (one shown). The well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A tubing string 110 is shown as having been lowered from the surface 106 into the wellbore 102. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

The wellhead 104 defines an attachment point for other equipment of the well system 100 to attach to the well. For example, the wellhead 104 can include a Christmas tree structure including valves used to regulate flow into or out of the wellbore 102, casing attachments such as casing spool outlets, pipe spools and hangers for coil tubing or wireline connections, a combination of these elements, or other structures incorporated in the wellhead 104. The wellhead 104 can include a vertical Christmas tree, a horizontal Christmas tree, or another orientation Christmas tree, each having a number of valves to control fluid flow and pressure across the wellhead 104. In the example well system 100 of FIG. 1, the tubing string 110 is shown as having been lowered from the wellhead 104 at the surface 106 into the wellbore 102. In the example well system 100, the tubing string 110 includes coil tubing that supports a well tool 116 at a downhole end of the tubing string 110. The tubing string 110 and the well tool 116 is rugged enough to withstand the harsh environment in the wellbore 102. The well tool 116 can take a variety of forms, for example, based on a desired well operation. In some instances, the well tool 116 includes an ESP positioned downhole in the wellbore 102 and coupled directly to the coil tubing of the tubing string 110. In some implementations, the well tool 116 promotes fluid flow through the coil tubing of the tubing string 110, through an annulus of the wellbore between the tubing string 110 and a wall of the wellbore 102, a combination of these, or elsewhere in the well system 100. The well tool 116 can couple to the coil tubing of the tubing string 110 with a threaded connection, integral connection, or other appropriate connection.

The tubing string 110 is supported at the wellhead 104. For example, the tubing string 110 can couple to and be supported by a tubing hanger, which couples to and is supported by a pipe spool of the wellhead 104. The wellhead 104 includes conduits for power, control, and communication connections between the tubing string 110 and respective power sources, control sources, and communication sources.

Figure 2:
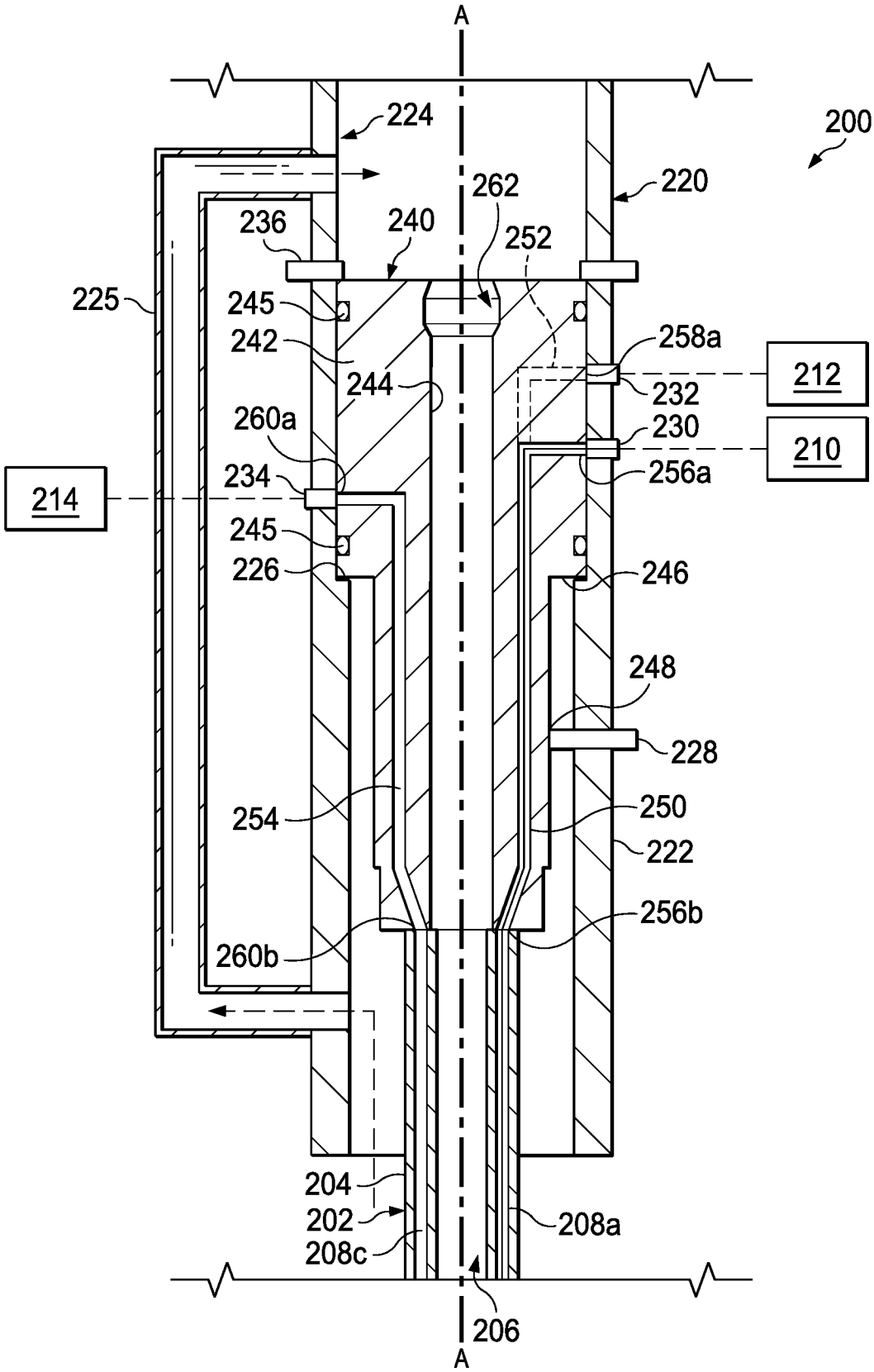
FIG. 2 is a schematic, partial cross-sectional side view of an example hanger system supporting an example tubing that can be used in the example well system of FIG. 1.

FIG. 2 is a schematic cross-sectional side view of an example hanger system 200 that can be used in the well system 100 of FIG. 1, in particular, in the wellhead 104. The example hanger system 200 is shown in FIG. 2 as supporting coil tubing 202 of the tubing string 110 of FIG. 1 disposed in the wellbore 102. The example hanger system 200 is disposed at least partially in the wellhead 104, and can be formed partially or completely in the wellhead 104. In some implementations, the coil tubing 202 connects to and supports an ESP (not shown) or other downhole well tool at a downhole end of or intermediate location along the coil tubing 202, and the example hanger system 200 allows for the connection of power, communication, and control to the ESP while the ESP is disposed downhole. For example, FIG. 2 includes a power supply 210, communication module 212, and a control fluid source 214, shown schematically in FIG. 2 and proximate to the hanger system 200, where the hanger system 200 provides channels for the connection of power, communication instrumentation, and control fluid between the respective sources and the ESP or other downhole well tool.

The example hanger system 200 includes a pipe spool 220 disposed at a wellhead (for example, the wellhead 104 of FIG. 1) of a well. The pipe spool 220 includes a spool housing 222 defining a spool bore 224 extending longitudinally (for example, axially along center axis A-A or parallel offset from axis A-A). In some implementations, the spool bore 224 is fluidly connected to the wellbore 102, such as the annulus of the wellbore 102. The spool bore 224 of the pipe spool 220 is shown as (substantially or exactly) cylindrical about center axis A-A; however, the shape of this spool bore 224 can vary. The spool bore 224 large enough to allow downhole tools, such as the ESP, to run through it and into the wellbore 102.

The example hanger system 200 also includes a tubing hanger 240 disposed in and supported by the spool bore 224. The tubing hanger 240 includes a hanger housing 242 that defines a hanger bore 244 extending longitudinally (for example, axially along center axis A-A or parallel offset from axis A-A) from a first longitudinal end of the hanger housing 242 to a second, opposite longitudinal end of the hanger housing 242. The hanger bore 244 can be an axial through-bore through the tubing hanger 240 such that the hanger bore 244 extends entirely through the tubing hanger 240. In some implementations, a cross-section of the hanger bore 244 is large enough to limit a velocity of fluid flowing through the hanger bore 244 below a velocity threshold. For example, the velocity threshold can be determined by industry standards or other factors. The tubing hanger 240 is removably coupled to the pipe spool 220, in that the tubing hanger 240 can be positioned in (for example, lowered into) the pipe spool 220 to engage with the pipe spool 220. The tubing hanger 240 couples to and supports the coil tubing 202 in the wellbore 102. In some instances, the tubing hanger includes a connector portion formed in or coupled to the hanger housing 242 at the second longitudinal end of the hanger housing, and the connector portion directly connects to and supports the coil tubing 202. In some implementations, the connector portion can incorporate a slip design, rope socket design, or other design type, and can incorporate electric penetrators that allow the secure electrical connection between the hanger 240 and the powered coil tubing 202. The hanger bore 244 directs fluid produced from the ESP and flowing through the central bore 206 of the coil tubing 202, for example, to a production fluid inlet of a wellhead.

In the example hanger system 200 of FIG. 2, the tubing hanger 240 includes a seal element 245 (two shown), for example, to engage and seal against an inner wall of the spool bore 224 of the spool housing 222. The seal element(s) 245 can include radial seals, and can provide a (substantial or complete) pressure seal or a (substantial or complete) fluid seal between the spool housing 222 and the hanger housing 242, for example, to prevent or reduce fluid leakage across the seal element 245. The seal element 245 are shown in FIG. 2 as radial seals; however, the seal element 245 can be shaped differently to match the profile of the spool bore 224. In some instances, the pipe spool 220 includes a bypass flow channel 225 that fluidly connects a portion of the spool bore 224 downhole of the seal element 245 to a second portion of the spool bore 224 uphole of the seal element 245. The bypass flow channel 225 can include a pipe running parallel to the spool bore 224. For example, the bypass flow channel 225 can allow some fluids, such as gas separated from a production stream from the ESP, to produce to surface and commingle with the well fluids produced through the ESP via a central bore 206 of the coil tubing 202 and hanger bore 244 of the tubing hanger 240. The bypass flow channel 225 can include a valve or other flow regulator to regulate flow along the bypass flow channel 225.

In some implementations, the pipe spool 220, tubing hanger 240, or both, can include coupling parts, such as axial positioning features or orientation features or both, to axially position and rotationally position the tubing hanger 240 in the pipe spool 220 at one or more predetermined positions. The coupling parts allow the tubing hanger 240 to land on the pipe spool 220 at a predetermined depth and rotationally orient the tubing hanger 240 relative to the pipe spool 220 at a predetermined orientation. The coupling parts are described in more detail later.

The tubing hanger 240 of the example hanger system 200 can be deployed and seated in the pipe spool 220, and couples to and supports the coil tubing 202 in the wellbore 102. The coil tubing 202 includes a coil tubing wall 204 that defines a central bore 206. The central bore 206 fluidly connects to the hanger bore 244 and extends along the coil tubing 202, for example, to fluidly connect to the ESP. The example hanger system 200 includes a network of channels through the pipe spool 220, tubing hanger 240, and coil tubing 202 that allow for the connection of power equipment, communication instrumentation, and control systems at a surface of the well to the downhole tool, such as the ESP, disposed in the wellbore on the coil tubing 202. The network of channels provides for connection of power, communication, and control between sources proximate to the wellhead (for example, at the surface) and the ESP disposed downhole, while also allowing for retrieval or deployment of the of the hanger 240, coil tubing 202, and ESP without requiring a workover rig operation or nippling down operation of the Christmas tree wellhead. For example, the network of channels includes at least three ports in the spool housing 222 of the pipe spool 220, at least three conduits in the hanger housing 242 of the tubing hanger 240 that align with respective ports of the pipe spool 220, and at least three channels embedded in the coil tubing wall 204 of the coil tubing 202 that align with respective conduits in the hanger housing 242. One or more or each of the ports and conduits can include caps, or plugs, at exposed ends of the ports and conduits, for example, to seal off end openings of the respective ports or conduits during installation or retrieval processes of the tubing hanger 240, coil tubing 202, and downhole tool or ESP. The channels embedded in the coil tubing wall 204 extend from an uphole longitudinal end of the coil tubing 202, where they couple to respective conduits of the tubing hanger 240, to the ESP or other downhole tool. The conduits of the tubing hanger 240 align with the ports of the pipe spool 220 to ultimately connect the embedded channels of the coil tubing 202 to respective sources connected at the wellhead proximate to the pipe spool 220. This network of channels allows for the connection of electric equipment (for example, wiring), communication equipment (for example, fiber optic cable or other), control equipment (for example, hydraulic fluid, chemical fluid, or other fluid types), or other equipment to directly connect between an ESP or other downhole tool and a source at a surface of the well.

Figure 3A:
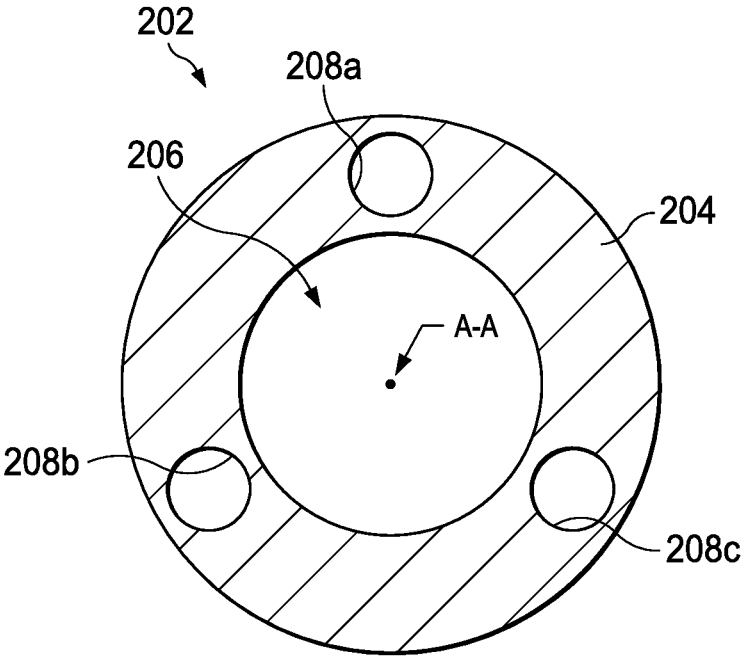
FIG. 3A is a schematic, partial cross-sectional top view of an example coil tubing including channels embedded in the coil tubing wall.

The network of channels can take many forms and include multiple channels. In the example hanger system 200 of FIG. 2, the coil tubing 202 includes three channels 208*a*, 208*b*, and 208*c* embedded in the wall 204 of the coil tubing 202. In some instances, the channels 208*a*, 208*b*, and 208*c* can be radially distributed evenly or unevenly about the coil tubing wall 204. In FIG. 2, the ports are shown in a cross sectional side view and are not distributed evenly; however, this distribution can be different. For example, FIG. 3A is a schematic, partial cross-sectional top view of the coil tubing 202 showing the channels 208*a*, 208*b*, and 208*c* distributed evenly about the coil tubing wall 204. The first channel 208*a* can be an electrical channel configured to deliver power through the coil tubing 202 to the ESP or other downhole tool. The second channel 208*b* can be a communication channel configured to transfer signal, data, or other communication along the coil tubing to and from the ESP or other downhole tool. The third channel 208*c* can be a control channel configured to transfer control fluid, such as hydraulic fluid or other control fluid type, along the coil tubing 202 to and from the ESP or other downhole tool. In some implementations, the coil tubing wall 204 can include more than three channels embedded in the coil tubing wall 204, for example, to provide additional, redundant, or alternative channels for power, communication, control fluid, or other instrumentation or equipment.

The pipe spool 220 includes an electrical port 230, a communication port 232, and a control port 234 in the spool housing 222, each port having a respective port opening in an inner surface (for example, radially inner surface adjacent the well bore) of the spool housing 222. The electrical port 230, communication port 232, and control port 234 extend through the spool housing 222. In some instances, the ports 230, 232, and 234 are horizontal ports extending from the radially inner surface of the pipe spool housing 222 to an outer surface of the pipe spool housing 222, and the ports 230, 232, and 234 can be radially distributed evenly or unevenly about the spool housing 222. In FIG. 2, the ports are shown in cross sectional side view and are not distributed evenly; however, this distribution can be different. In some instances, the ports 230, 232, and 234 are inclined ports. In some implementations, the electrical port 230 connects to a power supply 210, the communication port 232 connects to a communication module 212, and the control port 234 connects to a control fluid supply 214, in order to allow for electric, communicative, or control connections and equipment through the pipe spool 220. The power supply 210 can include an electric power supply, such as a generator, battery, or other power supply type. The communication module 212 can include a transmitter and receiver, computer system, processor, or other equipment configured to transmit and receive signal and data over fiber optic cable or other communication devices, and the communication module 212 can connect to fiber optic cable or other communication instrumentation to traverse and extend to the downhole tool or ESP. The control fluid supply 214 can include a chemical treatment fluid supply, hydraulic fluid supply, or other fluid supply that can control the respective control fluid between the downhole tool and the control fluid supply 214.

Figure 3B:
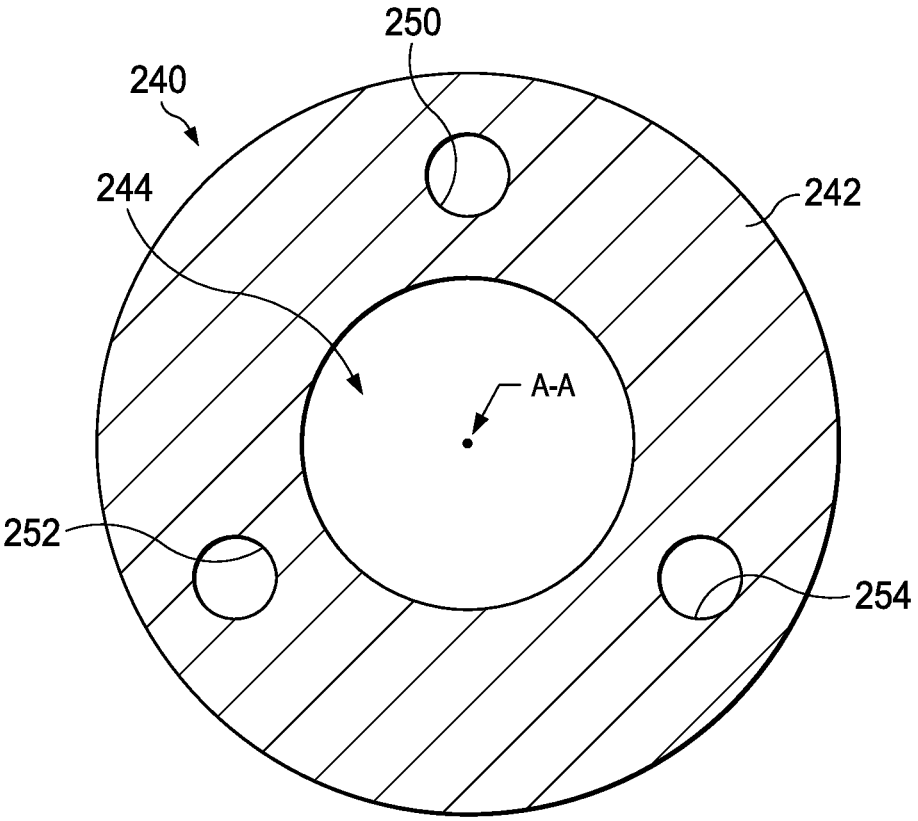
FIG. 3B is a schematic, partial cross-sectional top view of an example tubing hanger including conduits in the hanger housing.

The tubing hanger 240 includes an electrical conduit 250 extending through the hanger housing 242, a communication conduit 252 extending through the hanger housing 242, and a control conduit 254 extending through the hanger housing 242. With the tubing hanger 240 positioned in the pipe spool 220, the electrical conduit 250 aligns with the electrical port 230 of the pipe spool 220, the communication conduit 252 aligns with the communication port 232 of the pipe spool 220, and the control conduit 254 aligns with the control port 234 of the pipe spool 220. For example, a first end 256*a* of the electric conduit 250 aligns with the opening of the electrical port 230, a first end 258*a* of the communication conduit 252 aligns with the opening of the communication port 232 of the pipe spool 220, and a first end 260*a* of the control conduit 254 aligns with the opening of the control port 234 of the pipe spool 220. A second end 256*b* of the electrical conduit 250 opposite the first end 256*a* connects to the first channel 208*a* of the coil tubing 202. A second end 258*b* of the communication conduit 252 opposite the first end 258*a* connects to the second channel 208*b* of the coil tubing 202. A second end 260*b* of the control conduit 254 opposite the first end 260*a* connects to the third channel 208*c* of the coil tubing 202. In some instances, the conduits 250, 252, and 254 can be radially distributed evenly or unevenly about axis A-A in the hanger housing 242. In FIG. 2, the conduits are shown in a cross sectional side view and are not distributed evenly; however, this distribution can be different. For example, FIG. 3B is a schematic, partial cross-sectional top view of the tubing hanger 240 showing the conduits 250, 252, and 254 distributed evenly about axis A-A in the hanger housing 242.

In some implementations, one or more or all of the first end 256*a*, first end 258*a*, first end 260*a*, or opening of the ports in the pipe spool 220 includes a cap, or plug, over the respective opening to seal the respective opening. The cap provides a temporary seal at the opening to prevent or restrict unwanted infiltration of fluid, contaminants, or other unwanted material into the respective ports or conduits, for example, during deployment or retrieval of the tubing hanger 240 in the pipe spool 220. The cap(s) can be removed following installation of the tubing hanger 240 in the pipe spool 220 to allow for surface power, fiber optic or other communication equipment, or control fluid connection along the conduits. In some examples, the caps (or plugs) can have screws with hexagonal sockets on their tops to allow them to be tightened or untightened from the hanger with keys (for example, Allen keys). In some instances, the electric conduit 250, communication conduit 252, or both, allow for dry mate connections to the respective electrical port 230, communication port 232, or both, of the pipe spool 220.

The hanger system 200 allows rigless retrieval and deployment of the ESP or other downhole tool by retrieval and deployment of the tubing hanger 240 and coil tubing 202, while keeping the Christmas tree structure of the wellhead in place. In some instances, the tubing hanger 240 includes a latch structure proximate an uphole longitudinal end of the tubing hanger 240 to engage a retrieval and deployment tool to selectively retrieve or deploy the tubing hanger 240 in the pipe spool 220. The latch structure can take a variety of forms. For example, the latch structure of the tubing hanger 240 can include a latch profile 262, such as a fishing tool profile, threading, or other profile that can selectively engage with a retrieval and deployment tool.

The pipe spool 220 and tubing hanger 240 can have corresponding coupling parts to position and orient the tubing hanger 240 in the pipe spool 220, for example, to align the conduits of the tubing hanger 240 with the respective ports of the pipe spool 220. In some implementations, the pipe spool 220 and tubing hanger 240 include axial positioning features to axially position (for example, along axis A-A) the tubing hanger 240 in the pipe spool 220 at one or more predetermined axial positions. The axial positioning features can take a variety of forms. For example, in the example hanger system 200 of FIG. 2, the spool housing 222 of the pipe spool includes a shoulder 226 on a radially inward surface of the spool housing 222, and the hanger housing 242 includes a corresponding shoulder profile 246 on a radially outward surface of the hanger housing 242. The shoulder 226 and corresponding shoulder profile 246 engage each other to axially position the tubing hanger 240 on the pipe spool 220 at a predetermined, desired axial position. In some instances, the axial positioning features can be different. For example, the pipe spool 220 can include a different profile that the tubing hanger 240 can engage and land on. Similarly, the tubing hanger 240 can include a different profile that can engage and land on the pipe spool 220.

Figure 3C:
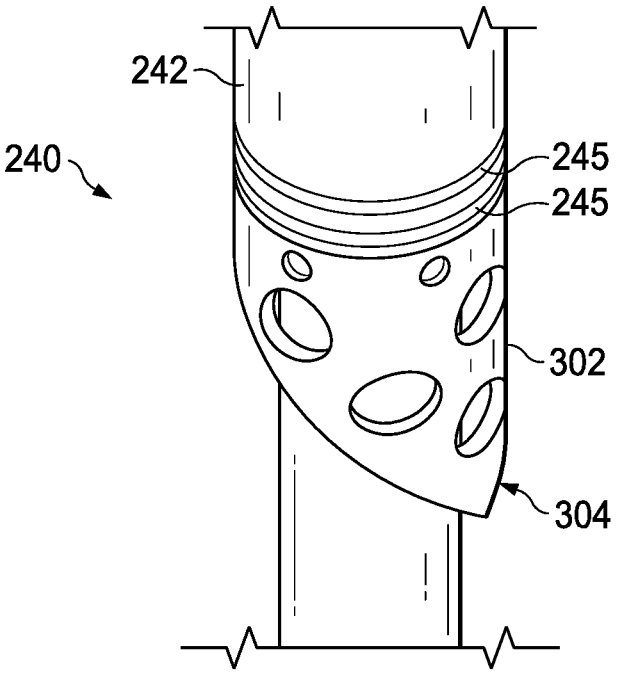
FIG. 3C is a partial schematic perspective view of the example tubing hanger of FIG. 2 including an example mule shoe coupled to the hanger housing of the tubing hanger.

In some implementations, the pipe spool 220 and tubing hanger 240 have corresponding orientation features to rotationally orient (for example, about axis A-A) the tubing hanger 240 in the pipe spool 220 at one or more predetermined radial positions. The orientation features can take a variety of forms, and can include a self-orienting feature. For example, in the example hanger system 200 of FIG. 2, the pipe spool 220 includes an orientation pin 228, and the tubing hanger 240 includes an orientation slot 248 configured to engage the orientation pin 228 of the pipe spool 220. The orientation slot 248, for example, can be formed in the hanger housing 242, formed in an orientation shoe coupled to or formed in the hanger housing 242, or otherwise formed in or coupled to the tubing hanger 240 to rotationally orient the tubing hanger 240 relative to the pipe spool 220. FIG. 3C is a partial schematic perspective view of the tubing hanger 240 of FIG. 2, and including a mule shoe 302 coupled to the hanger housing 242 of the tubing hanger 240. The mule shoe 302 includes an edge profile 304 that can engage the orientation pin 228 of the pipe spool 220 of FIG. 2 and rotate the tubing hanger 240 about axis A-A to a predetermined position. The mule shoe 302 forms a self-orienting feature of the tubing hanger 240, for example, in that the mule shoe 302 causes the tubing hanger 240 to rotationally orient itself in the pipe spool 220 as the tubing hanger 240 is lowered into the spool bore 224 of the pipe spool 220.

The coupling parts, including one or both of the axial positioning features or orientation features, can take other forms or include additional components to axially position and rotationally position the tubing hanger 240 relative to the pipe spool 220. For example, the pipe spool 220 can include a lock pin 236 to secure the tubing hanger 240 in the pipe spool 220 and substantially prevent uphole axial movement of the tubing hanger 240 while the lock pin 236 is engaged. The lock pin 236 can be retractable, for example, to allow for retrieval of the tubing hanger 240 from the pipe spool 220.

The example hanger system 200 provides connections for power, communication, and control fluid between a surface wellhead and a downhole powered ESP or other downhole tool, and provides for a rigless deployment and retrieval of the ESP or other downhole tool without rendering tree valves or other valves of a wellhead (for example, Christmas tree-type wellhead) non-functional. For example, a well operator can deploy or retrieve an ESP on a coil tubing supported on a tubing hanger without a workover rig or a nippling-down operation of the wellhead.

Figure 4:
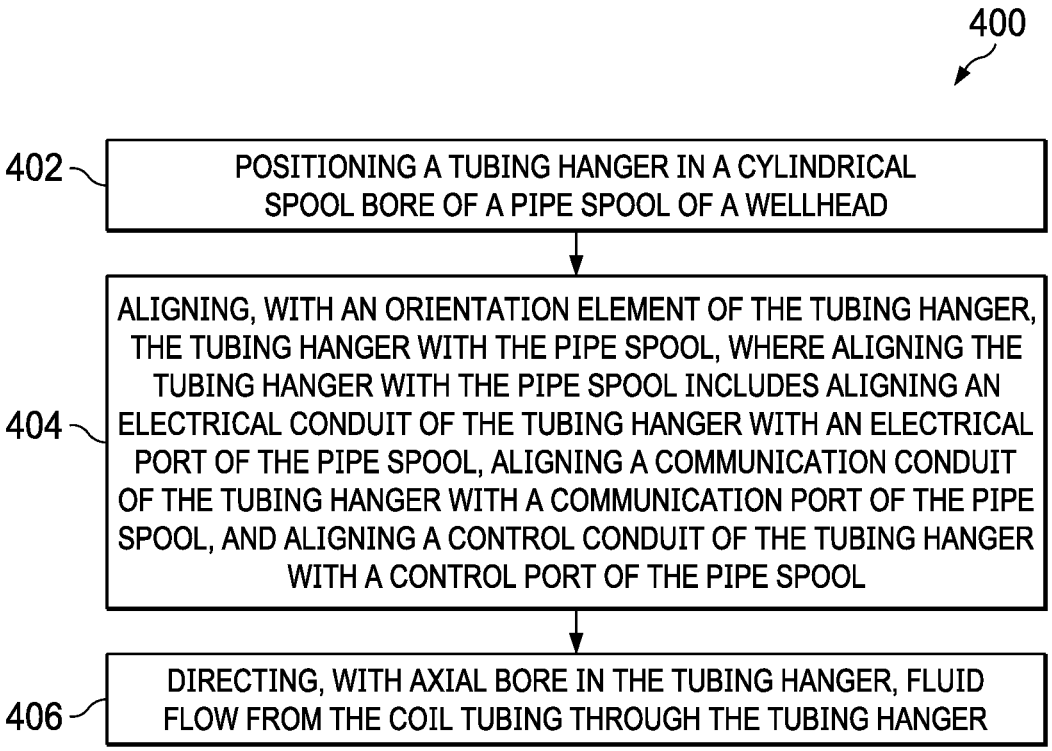
FIG. 4 is a flowchart describing an example method for connecting a hanger system in a well.

FIG. 4 is a flowchart describing an example method 400 for connecting a hanger system in a well, for example, performed by the example hanger system 200 of FIG. 2. At 402, a tubing hanger is positioned in a cylindrical spool bore of a pipe spool of a wellhead. At 404, an orientation element of the tubing hanger aligns the tubing hanger with the pipe spool. Aligning the tubing hanger with the pipe spool includes aligning an electrical conduit of the tubing hanger with an electrical port of the pipe spool, aligning a communication conduit of the tubing hanger with a communication port of the pipe spool, and aligning a control conduit of the tubing hanger with a control port of the pipe spool. The electrical port is configured to connect to a power supply, and the electrical conduit is configured to connect to a first channel of a coil tubing. The communication port is configured to connect to a communication module, and the communication conduit is configured to connect to a second channel of a coil tubing. The control port is configured to connect to a control fluid supply, and the control conduit is configured to connect to a third channel of a coil tubing. At 406, an axial bore in the tubing hanger directs fluid flow from the coil tubing through the tubing hanger.

A number of implementations have been described. Nevertheless, it will be understood that various modifications may be made without departing from the spirit and scope of the disclosure.

What is claimed is:

1. A hanger system for a well, the hanger system comprising:

a pipe spool configured to be disposed at a wellhead of a well, the pipe spool comprising:

a spool housing defining a cylindrical spool bore extending longitudinally through the spool housing;

an electrical port in the spool housing having an electrical port opening in an inner surface of the spool housing, the electrical port configured to connect to a power supply;

a communication port in the spool housing having a communication port opening in the inner surface of the spool housing, the communication port configured to connect to a communication module; and a control port in the spool housing having a control port opening in the inner surface of the spool housing, the control port configured to connect to a control fluid supply; and a tubing hanger configured to be disposed in the cylindrical spool bore and to removably couple to the pipe spool, the tubing hanger comprising:

a hanger housing defining a hanger bore extending from a first longitudinal end of the hanger housing to a second longitudinal end of the hanger housing opposite the first longitudinal end;

an electrical conduit extending through the hanger housing, a first end of the electric conduit configured to align with the electrical port opening of the pipe spool, and a second end of the electrical conduit opposite the first end configured to connect to a first channel of a coil tubing;

a communication conduit extending through the hanger housing, a first end of the communication conduit configured to align with the communication port opening of the pipe spool, and a second end of the communication conduit opposite the first end configured to connect to a second channel of the coil tubing; and a control conduit extending through the hanger housing, a first end of the control conduit configured to align with the control port opening of the pipe spool, and a second end of the control conduit opposite the first end configured to connect to a third channel of the coil tubing.

2. The hanger system of claim 1, where the hanger housing comprises a shoulder configured to land on and engage a corresponding shoulder profile of the spool housing.

3. The hanger system of claim 1, wherein the tubing hanger comprises an orientation element, and the pipe spool comprises an orientation profile, the orientation element configured to engage with the orientation profile to rotationally index the tubing hanger to the pipe spool.

4. The hanger system of claim 3, wherein the orientation element of the tubing hanger comprises an orientation shoe, and the orientation profile of the pipe spool comprises an orientation pin extending radially into the spool bore.

5. The hanger system of claim 1, further comprising a locking mechanism configured to detachably couple the tubing hanger to the pipe spool.

6. The hanger system of claim 5, wherein the locking mechanism comprises a lock pin of the pipe spool, the lock pin configured to engage with a locking profile of the tubing hanger.

7. The hanger system of claim 1, wherein the tubing hanger comprises a latching profile in the hanger housing at the first longitudinal end of the hanger housing, the latching profile configured to engage a latching mechanism.

8. The hanger system of claim 7, wherein the latching profile comprises a fishing neck or threading.

9. The hanger system of claim 1, wherein the tubing hanger comprises a sealing element configured to sealingly engage with the pipe spool.

10. The hanger system of claim 1, wherein the tubing hanger comprises a connector portion at the second longitudinal end of the hanger housing, where the electrical conduit, the communication conduit, and the control conduit extend to the connector portion, the connector portion configured to connect to and support the coil tubing.

11. The hanger system of claim 1, wherein the pipe spool comprises a bypass flow channel fluidly connecting a first portion of spool bore downhole of the tubing hanger to a second portion of the spool bore uphole of the tubing hanger.

12. A method for connecting a hanger system in a well, the method comprising:

positioning a tubing hanger in a cylindrical spool bore of a pipe spool of a wellhead;

aligning, with an orientation element of the tubing hanger, the tubing hanger with the pipe spool, where aligning the tubing hanger with the pipe spool comprises:

aligning an electrical conduit of the tubing hanger with an electrical port of the pipe spool, the electrical port configured to connect to a power supply, and the electrical conduit configured to connect to a first channel of a coil tubing;

aligning a communication conduit of the tubing hanger with a communication port of the pipe spool, the communication port configured to connect to a communication module, and the communication conduit configured to connect to a second channel of the coil tubing; and aligning a control conduit of the tubing hanger with a control port of the pipe spool, the control port configured to connect to a control fluid supply, and the control conduit configured to connect to a third channel of the coil tubing; and directing, with an axial bore in the tubing hanger, fluid flow from the coil tubing through the tubing hanger.

13. The method of claim 12, wherein positioning the tubing hanger in the spool bore of the pipe spool comprises landing on and engaging, with a shoulder of the tubing hanger, a shoulder profile of the pipe spool.

14. The method of claim 12, wherein the orientation element of the tubing hanger comprises a orientation shoe, and aligning the tubing hanger with the pipe spool comprises engaging, with the orientation shoe, an orientation pin of the pipe spool extending radially into the spool bore.

15. The method of claim 12, wherein the orientation element of the tubing hanger comprises an orientation pin, and aligning the tubing hanger with the pipe spool comprises engaging, with the orientation pin, an orientation slot of the pipe spool.

16. The method of claim 12, further comprising sealing the tubing hanger to the pipe spool with a sealing element of the tubing hanger.

17. The method of claim 12, further comprising locking the tubing hanger to the pipe spool with a locking mechanism of the pipe spool, the locking mechanism comprising a lock pin.

18. The method of claim 12, further comprising engaging, with a latching profile of the tubing hanger, a retrieval tool.

19. The method of claim 12, further comprising:

guiding, with the electrical conduit, an electrical connection from the power supply to the first channel of the coil tubing;

guiding, with the communication conduit, a communication line from the communication module to the second channel of the coil tubing; and guiding, with the control conduit, a control fluid from the control fluid supply to the third channel of the coil tubing.

20. A well hanger for a well, the well hanger comprising:

a tubing hanger coupled to and supporting a coil tubing, the tubing hanger configured to be removably coupled to a pipe spool, the tubing hanger comprising:

a hanger housing defining a hanger bore extending from a first longitudinal end of the hanger housing to a second longitudinal end of the hanger housing opposite the first longitudinal end;

an electrical conduit extending through the hanger housing, a first end of the electric conduit configured to align with an electrical port opening of the pipe spool, and a second end of the electrical conduit being connected to a first channel of a coil tubing;

a communication conduit extending through the hanger housing, a first end of the communication conduit configured to align with a communication port opening of the pipe spool, and a second end of the communication conduit being connected to a second channel of the coil tubing; and a control conduit extending through the hanger housing, a first end of the control conduit configured to align with a control port opening of the pipe spool, and a second end of the control conduit being connected to a third channel of the coil tubing.

* * * * *